US005507542A

United States Patent [19]

Eden

[11] Patent Number: 5,507,542

[45] Date of Patent: Apr. 16, 1996

[54] SHOPPING BAG HANDLE GRIP

[76] Inventor: Laurence E. Eden, 145 Nelson Ave., #4, Jersey City, N.J. 07307-3925

[21] Appl. No.: 389,281

[22] Filed: Feb. 9, 1995

[51] Int. Cl.[6] ..... B65D 33/06

[52] U.S. Cl. ..... 294/143; 294/162; 294/170

[58] Field of Search ..... 294/137, 141–143, 294/149, 151, 153–159, 162, 163, 165, 170; 16/114 R; 150/107, 108; 190/115–117; 224/151, 202, 257, 258, 925; 383/6, 13; D9/434, 455

[56] References Cited

U.S. PATENT DOCUMENTS

| | | | |
|---|---|---|---|
| D. 219,111 | 11/1970 | Moen | 294/170 X |
| D. 248,070 | 6/1978 | Catanzaro et al. | D6/131 |
| D. 266,488 | 10/1982 | Marshall | D9/434 |
| D. 302,062 | 7/1989 | Sable | D34/5 |
| D. 325,156 | 4/1992 | Sweeny | D8/300 |
| D. 337,053 | 7/1993 | Oden | D9/434 |
| D. 340,863 | 11/1993 | Daigle | 294/137 X |
| 4,159,729 | 7/1979 | Schwartz | 294/142 |
| 5,181,757 | 1/1993 | Montoya | 294/159 |
| 5,263,755 | 11/1993 | Thompson | 294/165 |
| 5,361,956 | 11/1994 | Recanati | 294/159 X |

*Primary Examiner*—Johnny D. Cherry
*Attorney, Agent, or Firm*—David L. Baker; Rhodes & Ascolillo

[57] ABSTRACT

An apparatus for carrying bags having a bag handle has a hand gripable handle member, a vertical support member attached to the hand gripable handle member and a bag supporting member attached to the vertical support member distal the hand gripable handle member. A first bag handle restriction member and a second bag handle restriction member are attached to the bag supporting member. A first attachment member is attached to a gripable handle first end and a second attachment member is attached to a gripable handle second end. A third attachment member is releasably attached to a bag supporting member first end and a fourth attachment member is releasably attached to a bag supporting member second end. There is a support strap member to assist the user to carry heavy loads on the shopping bag handle grip. The support strap is slidingly connected in a port of the first attachment member and in a port of the second attachment member. A first stop member is attached to the one end of the support strap member. A second stop member is attached to the other end of the support strap member.

5 Claims, 2 Drawing Sheets

SHOPPING BAG HANDLE GRIP

BACKGROUND OF THE INVENTION

1. Field of the Invention

This invention relates to an device connectable to a bag handle to enable a user to carry a shopping bag such as the bags made of thin plastic without a great deal of discomfort normally experienced when carrying such bags.

2. Description of the Related Art

Several patents have tried to solve the problem of how to carry one or more of the thin plastic bags for a period of time when they are heavily loaded without cutting off the circulation in the fingers.

U.S. Pat. No. Des. 266,488 to W. J. Marshall on Oct. 12, 1982 for a Handle for Shopping Bag or Similar Article shows a handle somewhat like a motorcycle handle grip with a section cut out to insert a bag handle.

U.S. Pat. No. Des. 325,156 to H. D. Sweeny on Apr. 7, 1992 for a Handle shows a U-shaped handle wherein a bag handle is placed.

U.S. Pat. No. Des. 337,053 to M. R. Oden on Jul. 6, 1993 for a Shopping Bag Handle Grip shows a grip to accept a bag handle. The grip has several ports into which a bag handle may be placed.

U.S. Pat. No. 5,263,755 to S. C. Thompson on Nov. 23, 1993 for a Portable Carrier describes a hand held carrier for carrying plastic bags that has a hinged lower portion and a handle with a spring-loaded pin to lock the hinged lower portion closed against the handle. The bags are placed onto the lower portion and the user grips the handle.

The present invention solves this problem by providing a comfortable handle to grip with the hand and by providing a strap that may, depending on the load carried in the bags, be attached at four points on the invention to relieve some of the stress on the hand and arm of the user.

SUMMARY OF THE INVENTION

Stores often supply the thin plastic bags or bags having cord handles to customers to carry their purchases. One lightly loaded bag can often be handled fairly easily. But, a heavily loaded bag or several bags not only are cumbersome to handle; they can begin to cut the circulation off in the fingers or palm of your hand. This can be painful even for a short time. The present invention not only distributes the weight more evenly, it removes the bag handle(s) from the hand. The present invention also provides a means to help reduce the chance of the bag handles slipping off of the bag supporting member. For those times when the load becomes too heavy for carrying the bags with just a handle, the present invention provides a shoulder support strap to take some of the weight off of the hand. In order to better distribute and balance the load, the strap may be connected to the bag supporting member. For intermediate loads the strap may be connected to just the carrying handle.

In one aspect of the present invention, an apparatus for carrying bags having a bag handle is described. The apparatus includes a hand gripable handle member and a vertical support member attached to the hand gripable handle member. A bag supporting member is attached to the vertical support member distal the hand gripable handle member. There is a first bag handle restriction member and a second bag handle restriction member attached to the bag supporting member. A first attachment member is attached to a gripable handle first end of the hand gripable handle member. A second attachment member is attached to a gripable handle second end of the hand gripable handle member. There is a support strap member connected at a first strap end to the first attachment member and connected at a second strap end to the second attachment member.

In another aspect of the present invention, an apparatus for carrying bags having a bag handle is described. The apparatus has a hand gripable handle member. There is a vertical support member attached to the hand gripable handle member and a bag supporting member attached to the vertical support member distal the hand gripable handle member. There is a first and a second end on the bag supporting member. A first bag handle restriction member and a second bag handle restriction member are attached to the bag supporting member. There is a first attachment member attached to a gripable handle first end and a second attachment member attached to a gripable handle second end of the hand gripable handle member. There is a support strap member. A third attachment member is connected to the support strap member and a fourth attachment member attached to the support strap member. The third attachment member is attached to the bag supporting member first end. The fourth attachment member is attached to the bag supporting member second end.

There is a first strap end slidingly connected to the first attachment member. A second strap end is slidingly connected to the second attachment member. There is a third attachment member restriction groove on the first end of the bag supporting member. There is a fourth attachment member restriction groove on the second end of the bag supporting member. The third attachment member is lodged in the third attachment member restriction groove and the fourth attachment member is lodged in the fourth attachment member restriction groove.

It is an object of this invention to provide a shopping bag handle grip to allow a user to carry plastic bags and other bags commonly found in stores without causing damage to the hands if the bag is heavily loaded.

It is another object of the invention to provide a shopping bag handle grip that will allow the user to use a shoulder strap to support some of the load if the bag is heavy.

DESCRIPTION OF THE PREFERRED EMBODIMENT

Figure 1:
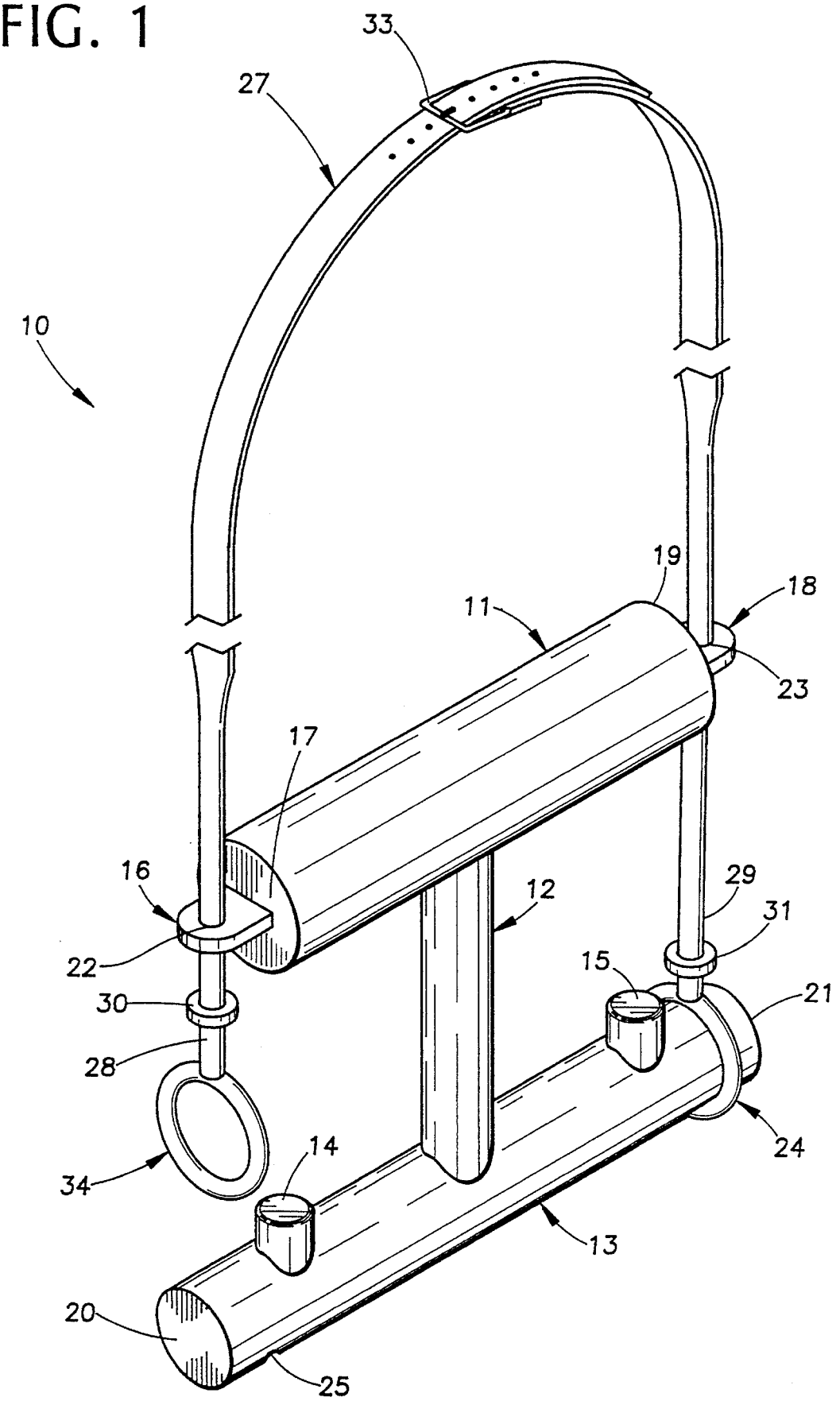
FIG. 1 is a perspective view of the Shopping Bag Handle Grip.
Figure 2:
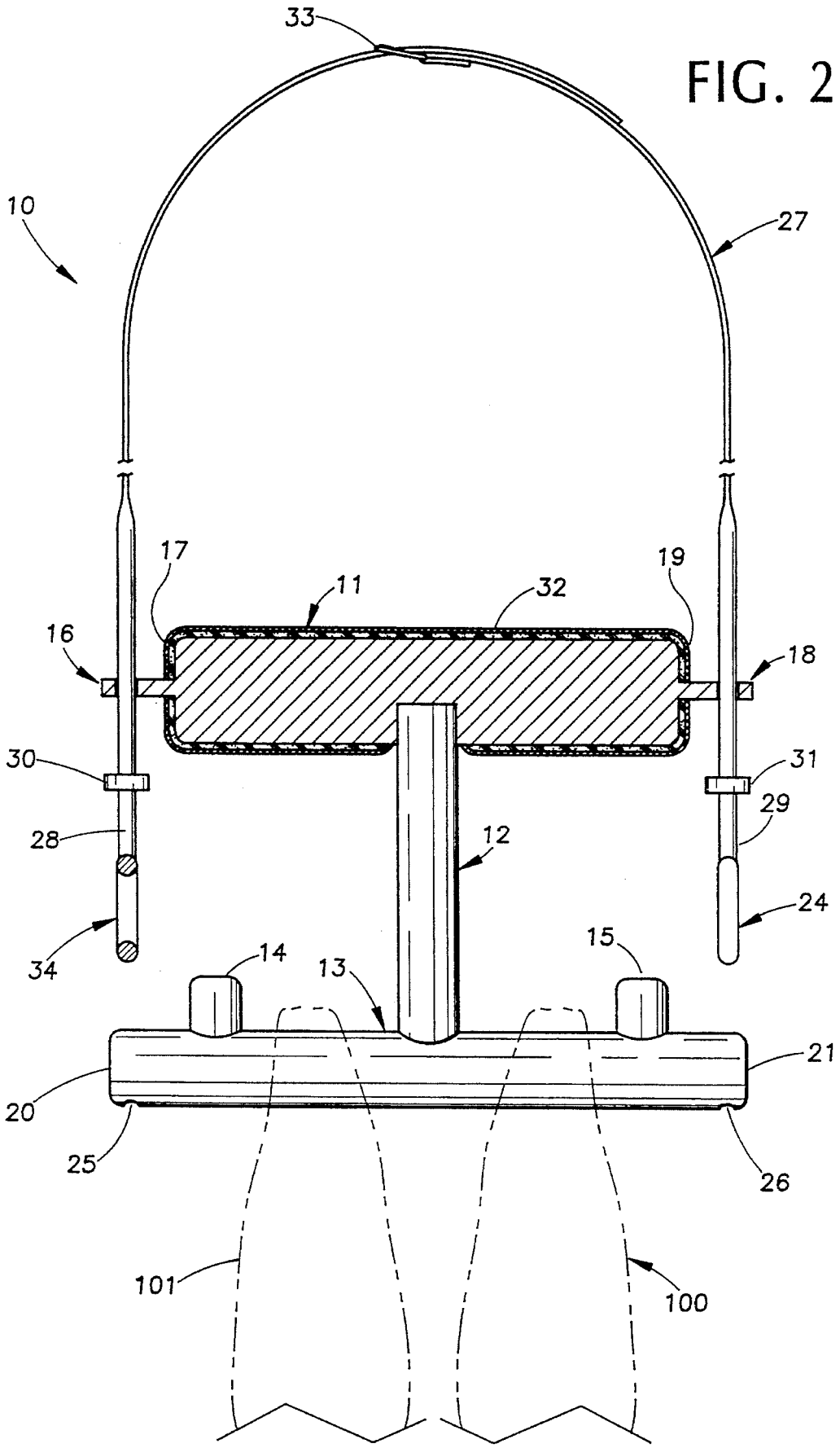
FIG. 2 is a front elevational view with a cross-section of the handle to show the connection to the vertical support member and to show the coating on the handle. A partial phantom view of the handles of a plastic shopping bag are shown suspended on the bag support member.

Referring to FIGS. 1 and 2, an apparatus 10 for carrying bags 100 having a bag handle 101 is shown and described. The apparatus 10 has a hand gripable handle member 11, a vertical support member 12 attached to the hand gripable handle member 11 and a bag supporting member 13 attached to the vertical support member 12 distal the hand gripable handle member 11. There is a first end 20 and a second end 21 on the bag supporting member 13. A first bag handle restriction member 14 is attached to the bag supporting member 13. A second bag handle restriction member 15 is also attached to the bag supporting member 13. A first attachment member 16 is attached to a gripable handle first end 17 of the hand gripable handle member 11 and a second attachment member 18 is attached to a gripable handle second end 19 of the hand gripable handle member 11. There is a first attachment member port 22 in the first attachment member 16. There is a second attachment member port 23 in the second attachment member 18.

There is a support strap member 27 to assist the user in carrying heavy loads on the shopping bag handle grip 10. A first strap end 28 is connected to the support strap member 27. A second strap end 29 is connected to the support strap member 27. A third attachment member 34 is connected to the first strap end 28. A fourth attachment member 24 is connected to the second strap end 29. The third attachment member 34 is releasably attached to the first end 20 of the bag supporting member 13 and the fourth attachment member 24 is releasably attached to a second end 21 of the bag supporting member 13. The first and second attachment members 16 and 18 may be molded as part of the handle 11 or may be fastened by a threaded fastener on a peg press-fitted into a hole in the ends of the handle. The third and fourth attachment members 34 and 24 are preferably elastic loops made an integral part of the support strap 27. But the loops could be attached in any suitable manner such as buckles or sewing. The loops may snugly grip the bag supporting member 13. The support strap 27 is placed slidingly within the first attachment member port 22 and within the second attachment member port 23. There is a third attachment member restriction groove 25 on the first end 20 of the bag supporting member 13. There is a fourth attachment member restriction groove 26 on the second end 21 of the bag supporting member 13. The third attachment member 34 is releasably placed in the third attachment member restriction groove 25. The fourth attachment member 24 is releasably placed in the fourth attachment member restriction groove 26. The restriction grooves help to keep the attachment members from slipping off the bag support member 13.

A first stop member 30 is attached to the one end 28 of the support strap member 27. The first and second attachment members 16 and 18 could be a peglike member having a port or hole 22 and 23 therethrough to receive the strap 27 and could swivel to allow the strap more freedom to move. The first stop member 30 selectively abuts the first attachment member 16 when the support strap member 27 is only slidingly connected to the first attachment member 16. A second stop member 31 is attached to the other end 29 of the support strap member 27. The second stop member 31 selectively abuts the second attachment member 18 when the support strap member 27 is only slidingly connected to the second attachment member 18. The handle member 11 has a slip-resistant gripping surface 32 of either plastic or cloth. The stop members abut the first and second attachment members thus supporting the weight on the handle member 11 and help to reduce the chance of the strap member becoming unattached from the first and second attachment members and could be wood, metal or plastic beads tightly secured near the ends of the strap near the third and fourth attachment members. The support strap member 27 may have an adjustable buckle member 33 to adjust the length of the support strap member.

In operation, one or more handles 101 of bags 100 may be placed on the bag supporting member 13 and restrained from slipping off the ends 20 and 21 of the bag supporting member by the bag restriction members 14 and 15 (usually two peg-like protuberances). If the load is heavier than the user desires to carry just by hand, the shoulder strap 27 (cloth, plastic or leather) may be used and only the first and second attachment members 16 and 18 on the handle 11 used to secure the strap 27 by abutting the stops 30 and 31. If the load is especially heavy, the strap 27 may be attached by way of the third and fourth attachment members 34 and 24 to the bag support member 13 and placed within the grooves 25 and 26 to help steady and balance the load along with supporting the weight. The handle 11 may be either cloth or plastic covered. (Dipping the handle into a liquid plastic material and allowing the material to dry would be one method of coating the handle. Cloth could be sewed on or placed on by adhesives.) The handle 11 and the bag support member 13 could be attached to the vertical support member 12 by drilling a hole into the handle 11 and bag support member 13 and press-fitting the vertical support member 12 into the holes. Adhesive could be used to further secure the attachment. The bag restriction members 14 and 15 could be secured in a like manner. The gripable handle member, the vertical support member and the bag support member could be made of wood, plastic or metal and formed by known methods for working with each media.

The foregoing descriptions and drawings of the invention are explanatory and illustrative, and various changes in shape, sizes and arrangements of parts as well as certain details of the illustrated construction may be made within the scope of the appended claims without departing from the spirit of the invention.

I claim:

1. An apparatus for carrying bags having a bag handle, the apparatus comprising:

(a) a hand gripable handle member;

(b) a vertical support member attached to the hand gripable handle member;

(c) a bag supporting member attached to the vertical support member distal the hand gripable handle member;

(d) a first bag handle restriction member attached to the bag supporting member;

(e) a second bag handle restriction member attached to the bag supporting member;

(f) a first attachment member attached to a gripable handle first end of the hand gripable handle member;

(g) a second attachment member attached to a gripable handle second end of the hand gripable handle member;

(h) a support strap member, connected at a first strap end, to the first attachment member; and (i) the support strap member, connected at a second strap end, to the second attachment member.

2. An apparatus for carrying bags having a bag handle, the apparatus comprising:

(a) a hand gripable handle member;

(b) a vertical support member attached to the hand gripable handle member;

(c) a bag supporting member attached to the vertical support member distal the hand gripable handle member;

(d) a first end on the bag supporting member;

(e) a second end on the bag supporting member;

(f) a first bag handle restriction member attached to the bag supporting member;

(g) a second bag handle restriction member attached to the bag supporting member;

(h) a first attachment member attached to a gripable handle first end;

(i) a second attachment member attached to a gripable handle second end of the hand gripable handle member;

(j) a support strap member;

(k) a third attachment member connected to the support strap member;

(l) the third attachment member attached to the bag supporting member first end;

(m) a fourth attachment member connected to the support strap member;

(n) the fourth attachment member attached to the bag supporting member second end;

(o) a first strap end slidingly connected to the first attachment member;

(p) a second strap end slidingly connected to the second attachment member;

(q) a third attachment member restriction groove on the first end of the bag supporting member;

(r) a fourth attachment member restriction groove on the second end of the bag supporting member;

(s) the third attachment member in the third attachment member restriction groove; and (t) the fourth attachment member in the fourth attachment member restriction groove.

3. An apparatus for carrying bags having a bag handle, the apparatus comprising:

a hand gripable handle member;

a vertical support member attached to the hand gripable handle member;

a bag supporting member attached to the vertical support member distal the hand gripable handle member;

a first end on the bag supporting member;

a second end on the bag supporting member;

a first bag handle restriction member attached to the bag supporting member;

a second bag handle restriction member attached to the bag supporting member;

a first attachment member attached to a gripable handle first end on the hand gripable handle member;

a first attachment member port in the first attachment member;

a second attachment member attached to a gripable handle second end on the hand gripable handle member;

a second attachment member port in the second attachment member;

a support strap member;

a first strap end on the support strap member;

a second strap end on the support strap member;

a third attachment member connected to the first strap end;

the third attachment member releasably attached to the first end of the bag supporting member;

a fourth attachment member connected to the second strap end;

the fourth attachment member releasably attached to the second end of the bag supporting member;

the support strap member slidingly within the first attachment member port and the second attachment member port;

a third attachment member restriction groove on the first end of the bag supporting member;

a fourth attachment member restriction groove on the second end of the bag supporting member;

the third attachment member in the third attachment member restriction groove;

the fourth attachment member in the fourth attachment member restriction groove;

a first stop member attached to the support strap member;

the first stop member selectively abutting the first attachment member;

a second stop member attached to the support strap member; and the second stop member selectively abutting the second attachment member.

4. An apparatus as described in claim 3, wherein the handle member further comprises a slip-resistant gripping surface.

5. An apparatus as described in claim 3, wherein the support strap member further comprises an adjustable buckle member to adjust the length of the support strap member.

* * * * *